US010226939B2

(12) United States Patent
Sawase et al.

(10) Patent No.: US 10,226,939 B2
(45) Date of Patent: Mar. 12, 2019

(54) LIQUID CIRCULATION APPARATUS AND LIQUID DISCHARGE APPARATUS

(71) Applicants: Hiroshi Sawase, Kanagawa (JP); Takahiro Yoshida, Ibaraki (JP)

(72) Inventors: Hiroshi Sawase, Kanagawa (JP); Takahiro Yoshida, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/875,578

(22) Filed: Jan. 19, 2018

(65) Prior Publication Data

US 2018/0272739 A1 Sep. 27, 2018

(30) Foreign Application Priority Data

Mar. 21, 2017 (JP) ..... 2017-053975

(51) Int. Cl.
*B41J 2/18* (2006.01)
*B41J 2/175* (2006.01)
(Continued)

(52) U.S. Cl.
CPC ..... *B41J 2/18* (2013.01); *B41J 2/04583* (2013.01); *B41J 2/14451* (2013.01);
(Continued)

(58) Field of Classification Search
CPC ..... B41J 2/18; B41J 2/04583; B41J 2/14451; B41J 2/17566; B41J 2/17596; B41J 2202/12; B41J 2/17509
See application file for complete search history.

(56) References Cited

U.S. PATENT DOCUMENTS

2013/0002772 A1* 1/2013 Hiratsuka ..... B41J 2/16526 347/85
2014/0232796 A1 8/2014 Kimura et al.
(Continued)

FOREIGN PATENT DOCUMENTS

JP 2008-246843 10/2008
JP 2012-006302 1/2012
(Continued)

OTHER PUBLICATIONS

"Resistance in the Fluid System", retrieved on Oct. 4, 2018, slides 15-16 (Year: 2018).*
IP.com search (Year: 2018).*

*Primary Examiner* — Lisa Solomon
(74) *Attorney, Agent, or Firm* — Duft & Bornsen, PC

(57) ABSTRACT

A liquid circulation apparatus includes a circulation channel through which a liquid is circulated via a liquid discharge head including a supply port and a discharge port. The circulation channel includes a first manifold communicating with the supply port of the liquid discharge head, a second manifold communicating with the discharge port of the liquid discharge head, a supply channel connecting the first manifold and the supply port of the liquid discharge head, and a discharge channel connecting the second manifold and the discharge port of the liquid discharge head. A fluid resistance from the first manifold to the supply port of the liquid discharge head via the supply channel is smaller than a fluid resistance from the second manifold to the discharge port of the liquid discharge head via the discharge channel.

10 Claims, 9 Drawing Sheets

(51) Int. Cl.
*B41J 2/14* (2006.01)
*B41J 2/045* (2006.01)

(52) U.S. Cl.
CPC ..... *B41J 2/17566* (2013.01); *B41J 2/17596* (2013.01); *B41J 2/17509* (2013.01); *B41J 2202/12* (2013.01)

(56) References Cited

U.S. PATENT DOCUMENTS

| | | | |
|---|---|---|---|
| 2016/0101629 | A1 | 4/2016 | Sawase |
| 2016/0129693 | A1 | 5/2016 | Moriwaki et al. |
| 2017/0087865 | A1 | 3/2017 | Yoshida et al. |
| 2017/0096015 | A1 | 4/2017 | Odaka et al. |
| 2017/0239949 | A1 | 8/2017 | Yoshida |

FOREIGN PATENT DOCUMENTS

| | | |
|---|---|---|
| JP | 2013-063528 | 4/2013 |
| JP | 2014-087983 | 5/2014 |

* cited by examiner

FIG. 12

| | No.1 | No.2 | No.3 | No.4 | No.5 |
|---|---|---|---|---|---|
| Pin (Pa) | 1000 | 1000 | 3498 | 1000 | 1000 |
| Pout (Pa) | −5000 | −5000 | −5000 | −5000 | −5000 |
| HEAD Rhead in1 | 1 | 1 | 1 | 1 | 1 |
| HEAD Rhead out1 | 2 | 2 | 2 | 2 | 2 |
| Rr1 | 2 | 2 | 2 | 2 | 2 |
| $\alpha$ | 0.667 | 0.667 | 0.667 | 0.667 | 0.667 |
| $\beta$ | 0.333 | 0.333 | 0.333 | 0.333 | 0.333 |
| Rin (Pa·s/m$^3$) | 1.00E+10 | 1.00E+07 | 1.00E+10 | 1.00E+10 | 1.00E+07 |
| Rout (Pa·s/m$^3$) | 1.00E+08 | 1.00E+08 | 1.00E+08 | 1.00E+08 | 1.00E+08 |
| Pa | −1500 | 997.5 | 998 | −3036 | 996 |
| Pb | −4975 | −4975 | −4975 | −4983 | −4983 |
| Qft (m$^3$/s) | 2.50E−07 | 2.50E−07 | 2.50E−07 | 2.50E−07 | 2.50E−07 |
| Qhead (m$^3$/s) | 0.00E+00 | 0.00E+00 | 0.00E+00 | 2.30E−07 | 2.30E−07 |
| $\alpha$ Qhead in DISCHARGE | 0.00E+00 | 0.00E+00 | 0.00E+00 | 1.54E−07 | 1.54E−07 |
| $\beta$ Qhead out DISCHARGE | 0.00E+00 | 0.00E+00 | 0.00E+00 | 7.68E−08 | 7.68E−08 |
| Qin (m$^3$/s) | 2.50E−07 | 2.50E−07 | 2.50E−07 | 4.04E−07 | 4.04E−07 |
| Qout (m$^3$/s) | 2.50E−07 | 2.50E−07 | 2.50E−07 | 1.73E−07 | 1.73E−07 |
| Qhead 1 (m$^3$/s) | 0.00E+00 | 0.00E+00 | 0.00E+00 | 1.80E−10 | 1.80E−10 |
| $\alpha$ Qhead in 1 | 0.00E+00 | 0.00E+00 | 0.00E+00 | 1.20E−10 | 1.20E−10 |
| $\beta$ Qhead out 1 | 0.00E+00 | 0.00E+00 | 0.00E+00 | 6.00E−11 | 6.00E−11 |
| Qft1 (m$^3$/s) | 1.95E−10 | 1.95E−10 | 1.95E−10 | 1.95E−10 | 1.95E−10 |
| Qin1 (m$^3$/s) | 1.95E−10 | 1.95E−10 | 1.95E−10 | 3.15E−10 | 3.15E−10 |
| Qout1 (m$^3$/s) | 1.95E−10 | 1.95E−10 | 1.95E−10 | 1.35E−10 | 1.35E−10 |
| Qr1 | 1 | 1 | 1 | 0.43 | 0.43 |
| Pm (Pa) | −2658 | −993 | −993 | −4084 | −2221 |

LIQUID CIRCULATION APPARATUS AND LIQUID DISCHARGE APPARATUS

CROSS-REFERENCE TO RELATED APPLICATIONS

This patent application is based on and claims priority pursuant to 35 U.S.C. §119(a) to Japanese Patent Application No. 2017-053975, filed on Mar. 21, 2017 in the Japan Patent Office, the entire disclosures of which is hereby incorporated by reference herein.

BACKGROUND

Technical Field

Aspects of this disclosure relate to a liquid circulation apparatus and a liquid discharge apparatus.

Related Art

As a liquid discharge head (hereinafter simply referred to as a "head"), there is a flow-through type head (circulation type head) that includes a supply channel connected to an individual liquid chamber communicating with a nozzle, a discharge channel communicating with the individual liquid chamber, a supply port communicating with the supply channel, and a discharge port communicating with the discharge channel.

The flow-through type head includes a circulation channel in which liquid circulates through the head. The circulation channel includes a supply side manifold and a collection side manifold. The supply side manifold communicates with the supply port of the head and the collection side manifold communicates with the discharge port of the head.

SUMMARY

In an aspect of this disclosure, a novel liquid circulation apparatus includes a circulation channel through which a liquid is circulated via a liquid discharge head including a supply port and a discharge port. The circulation channel includes a first manifold communicating with the supply port of the liquid discharge head, a second manifold communicating with the discharge port of the liquid discharge head, a supply channel connecting the first manifold and the supply port of the liquid discharge head, and a discharge channel connecting the second manifold and the discharge port of the liquid discharge head. A fluid resistance from the first manifold to the supply port of the liquid discharge head via the supply channel is smaller than a fluid resistance from the second manifold to the discharge port of the liquid discharge head via the discharge channel.

In another aspect of this disclosure, a novel liquid circulation apparatus includes a circulation channel through which a liquid is circulated via a liquid discharge head including a supply port and a discharge port. The circulation channel includes a first manifold communicating with the supply port of the liquid discharge head, a second manifold communicating with the discharge port of the liquid discharge head, a supply channel connecting the first manifold and the supply port of the liquid discharge head, and a discharge channel connecting the second manifold and the discharge port of the liquid discharge head. A length of the supply channel is smaller than a length of the discharge channel.

In still another aspect of this disclosure, a novel liquid circulation apparatus includes a circulation channel through which a liquid is circulated via a liquid discharge head including a supply port and a discharge port. The circulation channel includes a first manifold communicating with the supply port of the liquid discharge head, and a second manifold communicating with the discharge port of the liquid discharge head. The second manifold is disposed higher than the first manifold.

In still another aspect of this disclosure, a novel liquid discharge apparatus includes the liquid circulation apparatus as described above.

BRIEF DESCRIPTION OF THE DRAWINGS

The aforementioned and other aspects, features, and advantages of the present disclosure will be better understood by reference to the following detailed description when considered in connection with the accompanying drawings, wherein:

FIG. 12 is a table of calculations of the meniscus pressure Pm in the nozzles;

Figure 1:
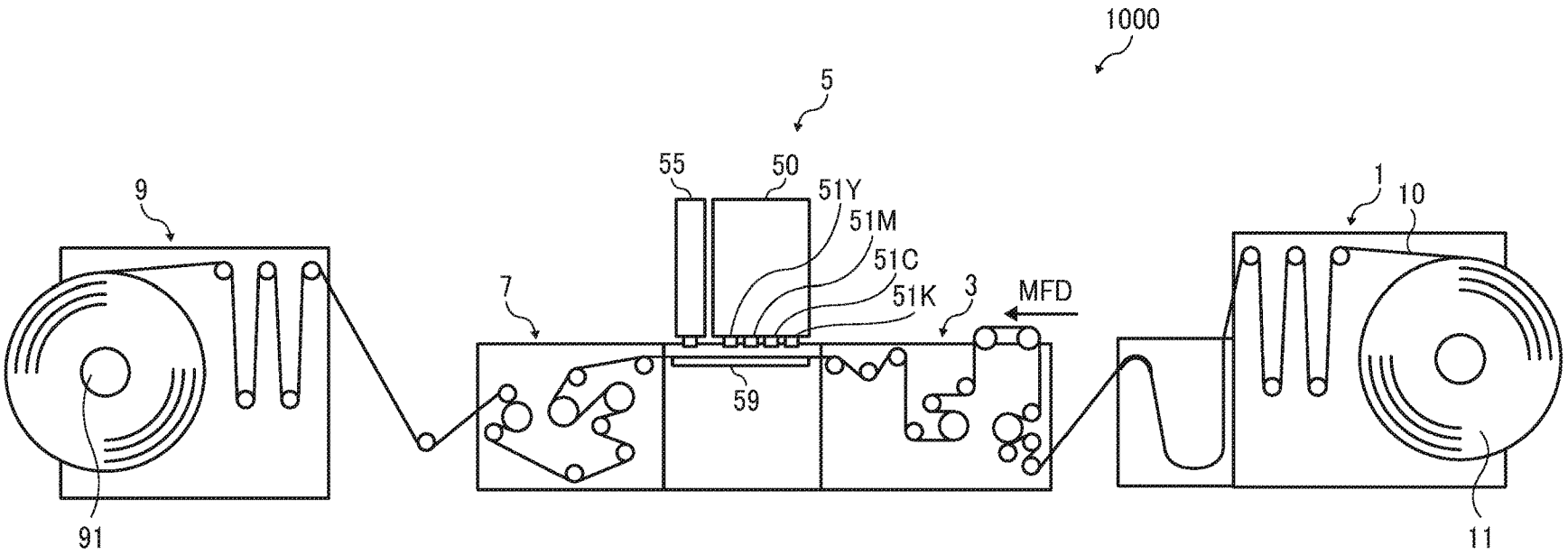
FIG. 1 is a schematic front view of a liquid discharge apparatus according to embodiments of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, embodiments of the present disclosure are described below wherein like reference numerals designate identical or corresponding parts throughout the several views.

An example of a liquid discharge apparatus 1000 according to a first embodiment of the present disclosure is described in detail below with reference to FIGS. 1 and 2.

FIG. 1 is a schematic front view of the liquid discharge apparatus 1000.

Figure 2:
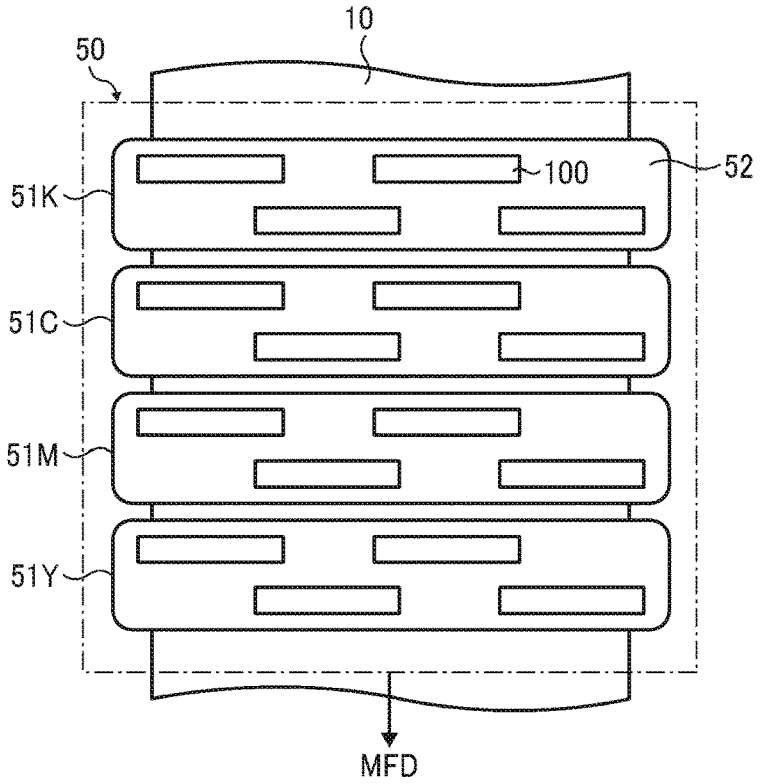
FIG. 2 is a plan view of a head unit of the liquid discharge apparatus of FIG. 1.

FIG. 2 is a plan view of a head unit 50 of the liquid discharge apparatus 1000 of FIG. 1.

The liquid discharge apparatus 1000 according to the present embodiment includes a feeder 1 to feed a continuous medium 10, a guide conveyor 3 to guide and convey the continuous medium 10, fed from the feeder 1, to a printing unit 5, the printing unit 5 to discharge liquid onto the continuous medium 10 to form an image on the continuous medium 10, a dryer 7 to dry the continuous medium 10, and an ejector 9 to eject the continuous medium 10.

The continuous medium 10 is fed from a winding roller 11 of the feeder 1, guided and conveyed with rollers of the feeder 1, the guide conveyor 3, the dryer 7, and the ejector 9, and wound around a winding roller 91 of the ejector 9.

In the printing unit 5, the continuous medium 10 is conveyed opposite a first head unit 50 and a second head unit 55 on a conveyance guide 59. The first head unit 50 discharges liquid to form an image on the continuous medium 10. Post-treatment is performed on the continuous medium 10 with treatment liquid discharged from the second head unit 55.

Here, as illustrated in FIG. 2, the first head unit 50 includes, for example, four-color full-line head arrays 51K, 51C, 51M, and 51Y (hereinafter, collectively referred to as "head arrays 51" unless colors are distinguished) from an upstream side in a feed direction of the continuous medium 10 (hereinafter, "medium feed direction") indicated by arrow MFD in FIG. 1.

The head arrays 51K, 51C, 51M, and 51Y are liquid dischargers to discharge liquid of black (K), cyan (C), magenta (M), and yellow (Y) onto the continuous medium 10 conveyed along the conveyance guide 59.

Note that the number and types of color are not limited to the above-described four colors of K, C, M, and Y and may be any other suitable number and types.

In each head array 51, for example, as illustrated in FIG. 2, a plurality of liquid discharge heads (also referred to as simply "heads") 100 is arranged in a staggered manner on a base 52 to form the head array 51. Note that the configuration of the head array 51 is not limited to such a configuration.

An example of a liquid discharge head according to embodiments of the present disclosure is described with reference to FIGS. 3 and 4.

Figure 3:
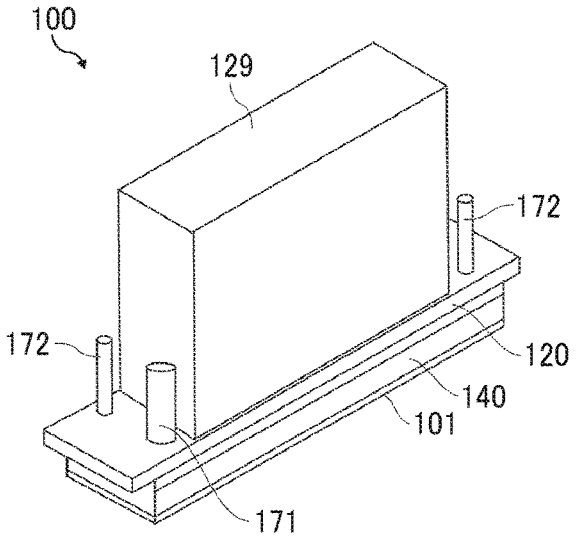
FIG. 3 is an outer perspective view of a head according to a present embodiment.

FIG. 3 is an outer perspective view of the head 100.

Figure 4:
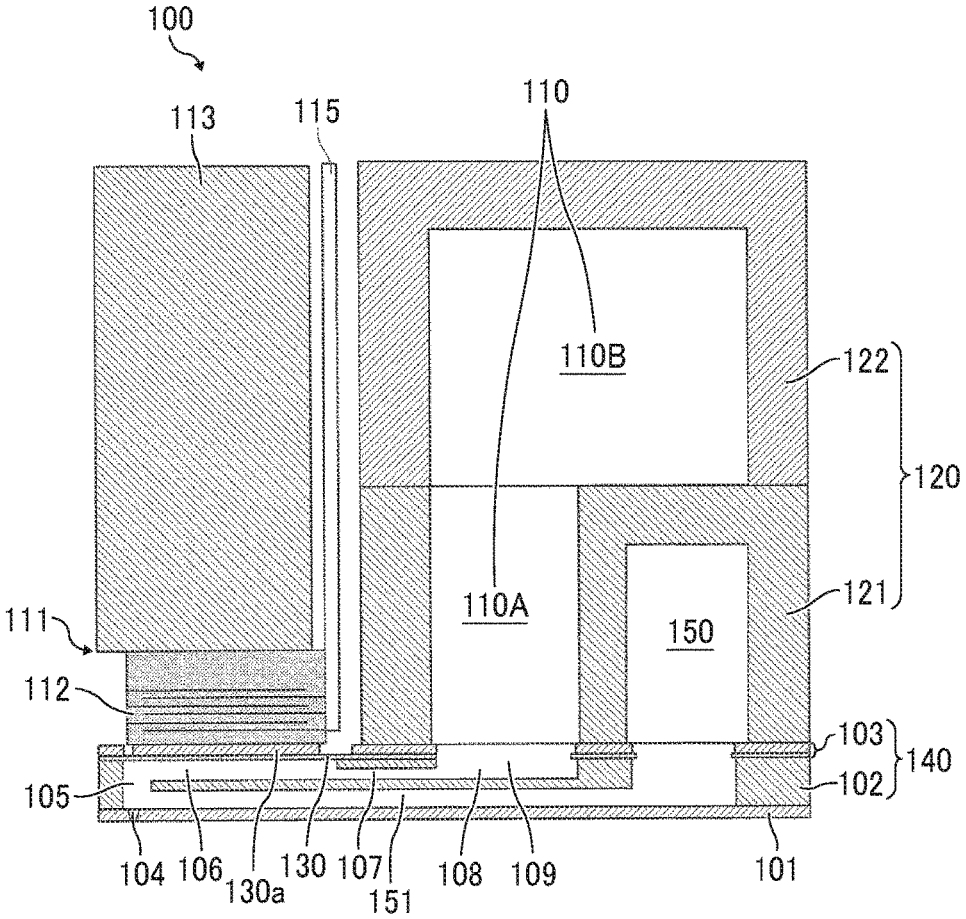
FIG. 4 is a cross-sectional view of the head in a direction perpendicular to a nozzle array direction in which nozzles are arrayed in a row direction (a longitudinal direction of an individual-liquid-chamber)

FIG. 4 is a cross-sectional view of the head 100 in a direction perpendicular to a nozzle array direction in which nozzles 104 are arrayed in a row direction (a longitudinal direction of an individual-liquid-chamber 106).

The head 100 includes a nozzle plate 101, a channel substrate 102, and a diaphragm member 103 as a wall member, laminated one on another and bonded to each other.

The head 100 includes piezoelectric actuators 111 to displace a vibration portions 130 of the diaphragm member 103, a common-liquid-chamber substrate 120 also served as a frame member of the head 100, and a cover 129.

The channel substrate 102 and the diaphragm member 103 constitute a channel member 140.

The nozzle plate 101 includes multiple nozzles 104 to discharge liquid.

The channel substrate 102 includes through-holes and grooves that form individual liquid chambers 106, supply side fluid restrictors 107, and liquid introduction portions 108. The individual liquid chambers 106 communicate with the nozzles 104 via the nozzle communication channel 105. The supply side fluid restrictors 107 communicate with the individual liquid chambers 106. The liquid introduction portions 108 communicate with the supply side fluid restrictors 107.

The nozzle communication channel 105 communicates with each of the nozzle 104 and the individual-liquid-chamber 106.

The liquid introduction portions 108 communicate with the supply side common-liquid-chamber 110 via the opening 109 of the diaphragm member 103.

The diaphragm member 103 includes the deformable vibration portions 130 constituting wall of the individual liquid chambers 106 of the channel substrate 102.

In the present embodiment, the diaphragm member 103 has a two-layer structure including a first layer and a second layer. The first layer forms thin portions from the channel substrate 102. The second layer forms thick portions. The first layer includes the deformable vibration portions 130 at positions corresponding to the individual liquid chambers 106. Note that the diaphragm member 103 is not limited to the two-layer structure and the number of layers may be any other suitable number.

On the opposite side of the individual-liquid-chamber 106 of the diaphragm member 103, there is arranged the piezoelectric actuator 111 including an electromechanical transducer element as a driver (e.g., actuator, pressure generator) to deform the vibration portions 130 of the diaphragm member 103.

The piezoelectric actuator 111 includes piezoelectric elements 112 bonded on a base 113. The piezoelectric elements 112 are groove-processed by half cut dicing so that each of the piezoelectric elements 112 includes a desired number of pillar-shaped piezoelectric elements 112 that are arranged in certain intervals to have a comb shape.

The piezoelectric element 112 is joined to a convex portion 130*a*, which is a thick portion having an island-like form formed on the vibration portions 130 of the diaphragm member 103.

In addition, a flexible printed circuit (FPC) 115 is connected to the piezoelectric elements 112.

The common-liquid-chamber substrate 120 includes a supply side common-liquid-chamber 110 and a drainage-side common-liquid-chamber 150.

The supply side common-liquid-chamber 110 is communicated with supply ports 171. The drainage-side common-liquid-chamber 150 is communicated with the discharge ports 172 (See FIG. 3).

Note that, in the present embodiment, the common-liquid-chamber substrate 120 includes a first common-liquid-chamber substrate 121 and a second common-liquid-chamber substrate 122. The first common-liquid-chamber substrate 121 is bonded to the diaphragm member 103 of the channel member 140. The second common-liquid-chamber substrate 122 is laminated on and bonded to the first common-liquid-chamber substrate 121.

The first common-liquid-chamber substrate 121 includes a downstream common-liquid-chamber 110A and the drainage-side common-liquid-chamber 150. The downstream common-liquid-chamber 110A is part of the supply side common-liquid-chamber 110 communicated with the liquid introduction portion 108. The drainage-side common-liquid-chamber 150 communicates with a drainage channel 151.

The second common-liquid-chamber substrate 122 includes an upstream common-liquid-chamber 110B that is a remaining portion of the supply side common-liquid-chamber 110.

The channel substrate 102 includes the drainage channels 151 formed along a surface direction of the channel substrate 102 and communicated with the individual liquid chambers 106 via the nozzle communication channel 105.

The drainage channels 151 communicate with the drainage-side common-liquid-chamber 150.

In the liquid discharge head 100 thus configured, for example, when a voltage lower than a reference potential (intermediate potential) is applied to the piezoelectric element 112, the piezoelectric element 112 contracts. Accordingly, the vibration portion 130 of the diaphragm member 103 is pulled to increase the volume of the individual-liquid-chamber 106, thus causing liquid to flow into the individual-liquid-chamber 106.

When the voltage applied to the piezoelectric element 112 is raised, the piezoelectric element 112 extends in a direction of lamination. Accordingly, the vibration portion 130 of the diaphragm member 103 deforms in a direction toward the nozzle 104 and the volume of the individual-liquid-chamber 106 reduces. Thus, liquid in the individual-liquid-chamber 106 is pressurized and discharged from the nozzle 104.

Liquid not discharged from the nozzles 104 passes the nozzles 104, and are drained from the drainage channels 151 to the drainage-side common-liquid-chamber 150 and supplied from the drainage-side common-liquid-chamber 150 to the supply side common-liquid-chamber 110 again through an external circulation route.

Note that the driving method of the head 100 is not limited to the above-described example (pull-push discharge). For example, pull discharge or push discharge may be performed in response to the way to apply the drive waveform.

Next, an example of a liquid circulation apparatus 200A according to the first embodiment of the present disclosure is described with reference to FIG. 5.

Figure 5:
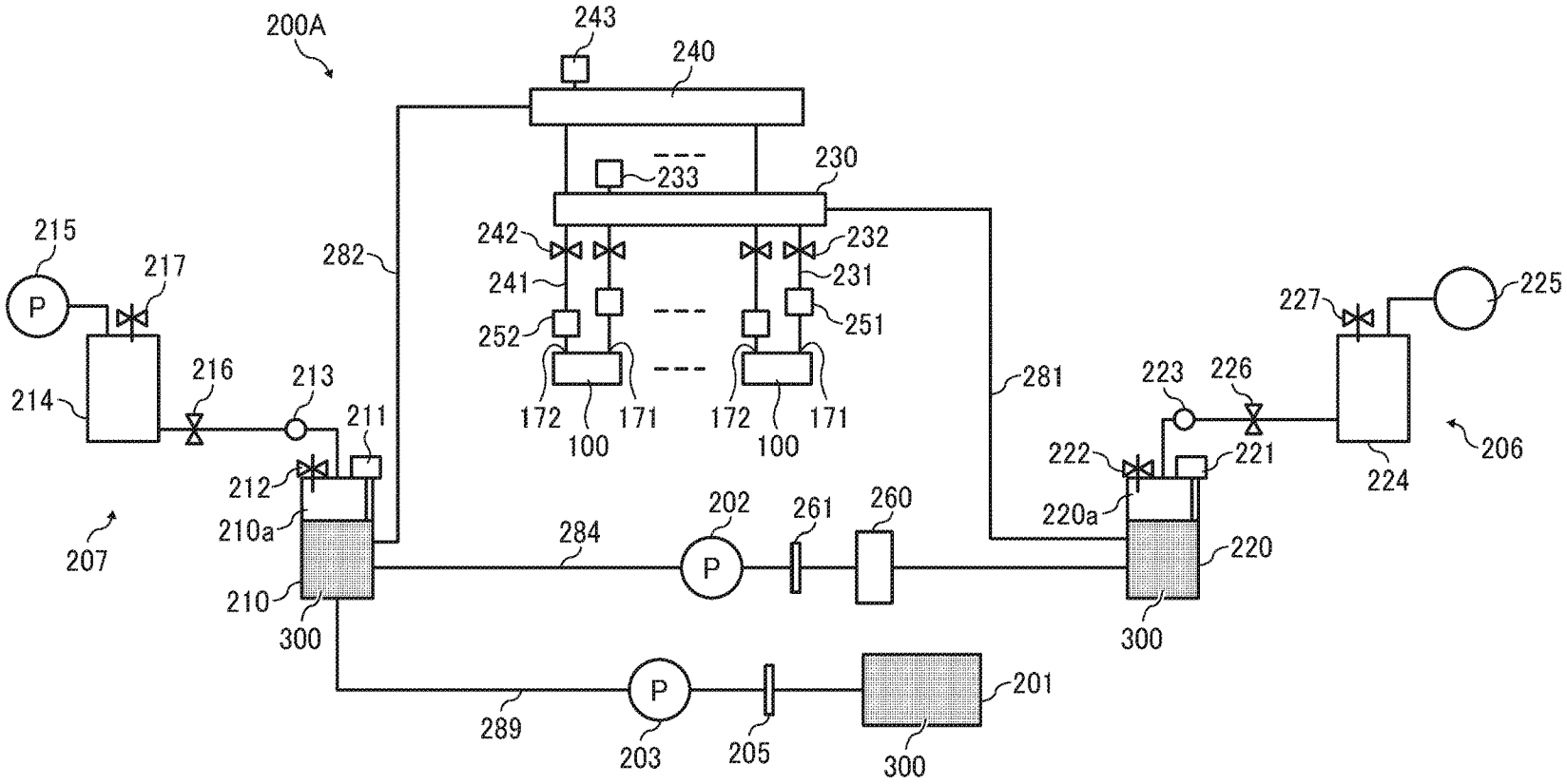
FIG. 5 is a circuit diagram of the liquid circulation apparatus according to a first embodiment of the present disclosure.

FIG. 5 is a circuit diagram of the liquid circulation apparatus 200A.

A liquid circulation apparatus 200A serving as a liquid supply apparatus includes a main tank 201, a first sub tank 220, a second sub tank 210, a first supply pump 202, and a second supply pump 203. The main tank 201 stores liquid 300 to be discharged by the heads 100. The main tanks 102 acts as a liquid storing device. The main tank 201 may be a liquid cartridge detachable to the liquid circulation apparatus 200A.

The liquid circulation apparatus 200A further includes a first manifold 230, a second manifold 240, a pressure head tank 251, a decompression head tank 252, and a degassing device 260. A plurality of heads 100 communicate with the first manifold 230 and the second manifold 240. The pressure head tank 251 and the decompression head tank 252 are provided for each of the heads 100. The degassing device 260 removes dissolved gas in the liquid.

In the first embodiment, the liquid is supplied from the second sub tank 210 to the first sub tank 220 via a liquid channel 284 by the first supply pump 202.

The degassing device 260 and a filter 261 are arranged on the liquid channel 284.

Further, the liquid is supplied from the main tank 201 to the second sub tank 210 via a liquid channel 289 by the second supply pump 203.

The second sub tank 210 includes a gas chamber 210*a*. Thus, liquid and gas coexist in the second sub tank 210.

The second sub tank 210 includes a liquid detector 211 to detect liquid surface of the liquid 300 and a solenoid valve 212 that constitutes an air release mechanism to release inside the second sub tank 210 to the outside air.

A second adjuster 207 is connected to the second sub tank 210 to adjust a pressure inside the second sub tank 210.

The second adjuster 207 includes a pressure adjustment mechanism (regulator) 213, a decompression buffer tank 214, and a vacuum pump 215 as a gas pump.

A solenoid valve 216 is provided between the regulator 213 and the decompression buffer tank 214.

A solenoid valve 217 is provided on the decompression buffer tank 214.

The first sub tank 220 includes a gas chamber 220*a*. Thus, liquid and gas coexist in the first sub tank 220.

The first sub tank 220 includes a liquid detector 221 to detect liquid surface of the liquid 300 and a solenoid valve 222 that constitutes an air release mechanism to release inside the second sub tank 210 to the outside air.

A first adjuster 206 is connected to the first sub tank 220 to adjust a pressure inside the first sub tank 220.

The first adjuster 206 includes a pressure adjustment mechanism (regulator) 223, a pressure buffer tank 224, and a compressor 225.

A solenoid valve 226 is provided between the regulator 223 and the pressure buffer tank 224.

A solenoid valve 227 is provided on the pressure buffer tank 224.

The first sub tank 220 is connected to the first manifold 230 via the liquid channel 281.

The first manifold 230 is connected to a supply port 171 (See FIG. 3) of the head 100 via the supply channel 231.

The supply channel 231 is connected to the supply port 171 (See FIG. 3) of the head 100 via the pressure head tank 251.

A solenoid valve 232 is provided on an upstream of the pressure head tank 251 on the supply channel 231 to open and close the supply channel 231.

A pressure sensor 233 is provided on the first manifold 230.

The second sub tank 210 is connected to the second manifold 240 via the liquid channel 282.

The second manifold 240 is connected to a discharge port 172 (See FIG. 3) of the head 100 via a discharge channel 241.

The discharge channel 241 is connected to the discharge port 172 (See FIG. 3) of the head 100 via the decompression head tank 252.

A solenoid valve 242 is provided on a downstream of the decompression head tank 252 on the discharge channel 241 to open and close the discharge channel 241.

A pressure sensor 243 is provided on the second manifold 240.

Here, a circulation channel is configured by a route started from the second sub tank 210 and returned to the first sub tank 220 via the liquid channel 284, the degassing device 260, the first sub tank 220, the liquid channel 281, the first manifold 230, head 100, the second manifold 240, and the second sub tank 210.

Further, the liquid is filled from the main tank 201 to the second sub tank 210 by the second supply pump 203 when a circulation amount of the liquid is less than a predetermined amount.

Further, the first sub tank 220, the second sub tank 210, and the first supply pump 202 configure a pressure generator to generate a pressure for circulating liquid in the circulation channel.

Next, a liquid circulation method in the liquid circulation apparatus 200A (liquid circulation system) according to the first embodiment of the present disclosure is described.

(1) Liquid flow from the main tank 201 to the second sub tank 210.

When the liquid detector 211 detects liquid shortage in the second sub tank 210, the second supply pump 203 is driven to supply the liquid to the second sub tank 210 from the main tank 201 via the liquid channel 289 until the liquid detector 211 detects that the liquid level in the second sub tank 210 is full.

(2) Liquid flow from the second sub tank 210 to the first sub tank 220.

The liquid is supplied from the second sub tank 210 to the first sub tank 220 via the liquid channel 284 by driving the first supply pump 202.

(3) Liquid flow from the first sub tank 220 to the second sub tank 210 through the liquid-circulable heads 100.

The first adjuster 206 adjusts the pressure in the first sub tank 220 to be a first target pressure (positive pressure, for example).

On the other hand, the second adjuster 207 adjusts the pressure in the second sub tank 210 to be a second target pressure (negative pressure, for example).

Thus, a differential pressure is generated between the first sub tank 220 and the second sub tank 210.

According to this differential pressure, the liquid can circulate between the first sub tank 220 and the second sub tank 210 via the liquid channel 281, the first manifold 230, a plurality of the supply channels 231, a plurality of pressure head tanks 251, a plurality of heads 100, a plurality of decompression head tanks 252, a plurality of discharge channels 241, the second manifold 240, and the liquid channel 282.

The liquid detectors 211 and 221 may be a detector using a float, a detector using at least two electrodes to detect an existence of liquid according to a voltage output, or a laser-type detector.

Further, interior of the first sub tank 220 and the second sub tank 210 may be communicated with outside air by driving the solenoid valves 222 and 212.

Next, a formation of a negative pressure in a nozzle meniscus in the nozzles 104 (pressure setting of the first sub tank 220 and the second sub tank 210) is described below.

Generally, the pressure applied to the nozzle meniscus is controlled to be negative when the head 100 discharges liquid from the nozzles 104.

The negative pressure inside the nozzles 104 prevents a leak or an overflow of liquid from the nozzles 104.

Further, pulsation of the pressure may be generated in the nozzle meniscus at a start and an end of the discharge process when the high-speed discharge is performed.

At this time, the negative pressure in the nozzles 104 prevents a leak or an overflow of liquid from the nozzles 104 even when the positive pressure is temporary generated in the nozzles 104 by the pulsation.

When a circulation type liquid discharge head is used, generally, a pressure in the first sub tank 220 is set to positive and a pressure in the second sub tank 210 is set to negative.

More specifically, a fluid resistance Rin and a fluid resistance Rout are previously calculated or measured. The fluid resistance Rin is a fluid resistance from the first sub tank 220 to the nozzle 104 of the head 100. The fluid resistance Rout is a fluid resistance from the nozzle 104 of the head 100 to the second sub tank 210.

Then, a pressure Pin of the first sub tank 220 and a pressure Pout of the second sub tank 210 are set according to the fluid resistance Rin and Rout. Thus, a target pressure Pn can be generated in the nozzle meniscus according to a fluid resistance ratio of Rin and Rout and a value of Pin and Pout, as similar to a voltage division of series resistance.

If a flow rate of circulated liquid is referred to as "I", $$Pn-Pin=I\times Rin \text{ and } Pout-Pn=I\times Rout.$$

Here, the following Equation 1 is obtained by deleting "I" from both sides of the above-described equations and transforming the above-described equations.

$$Pn=(Pout+Rout/Rin\times Pin)/(1+Rout/Rin) \quad \text{[Equation 1]}$$

The Equation 1 becomes Pn=(Pout+Pin)/2 when Rin=Rout.

Thus, it is understood that the pressure in the nozzle meniscus is determined according to the set pressure and the fluid resistance ratio.

Figure 6:
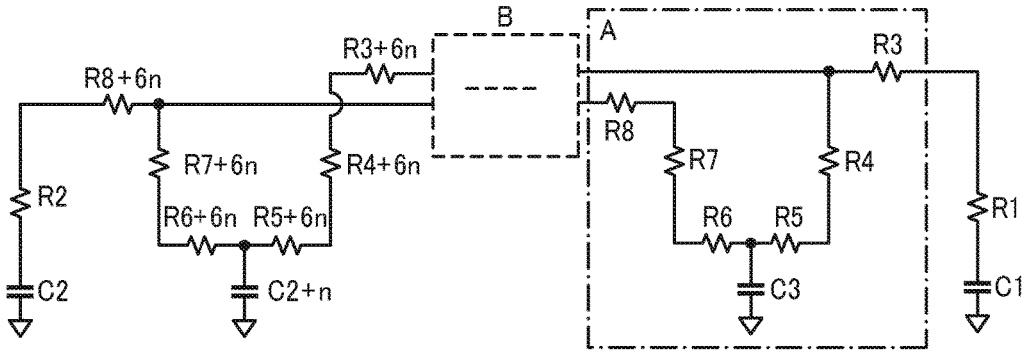
FIG. 6 is a schematic view of an equivalent circuit of the first embodiment.

Here, a schematic view of the liquid circulation apparatus 200A modeled as an equivalent circuit is illustrated in FIG. 6.

Line head is assumed in this schematic view. The head 100 is communicated with the supply channel 231 and a circulation channel (discharge channel) 241 in a module A in FIG. 6.

A plurality of the module A is arranged in parallel within a frame B in FIG. 6.

Further, the first sub tank 220, the second sub tank 210, and the nozzle meniscus can be modeled as a capacitor component C1 (the first sub tank 220), C2 (the second sub tank 210), C2+n (the nozzle meniscus), and C3 (the nozzle meniscus) where the voltage accumulates.

The liquid channels can be modeled as a resistance component that generates a voltage drop.

Thus, Rin can be represented by a resistance of the liquid channel 281 (R1), a resistance of a part of the first manifold 230 (R3), a resistance of the supply channel 231 (R4), and a resistance from the supply port 171 to the nozzle 104 of the head 100 (R5).

On the other hand, Rout can be represented by a resistance from the nozzle 104 to the discharge port 172 of the head 100 (R6), a resistance of the discharge channel 241 (R7), a resistance of a part of the second manifold 240 (R8), and a resistance of the liquid channel 282 (R2).

Pin represents a voltage generated by a voltage source (air pump, for example) and a current source (liquid pump, for example) in the first sub tank 220.

Pout represents a voltage generated by a voltage source (air pump, for example) and a current source (liquid pump, for example) in the second sub tank 210.

Further, the resistance of the part of the first manifold 230 (R3 . . . R3+6n) and the resistance of the part of the second manifold 240 (R8 . . . R8+6n) are appropriately considered to calculate the pressure in the nozzle meniscus in each heads 100 according to a position where the first manifold 230 and the second manifold 240 are mounted.

However, the resistance of the first manifold 230 and the second manifold 240 may be ignored in the calculation of the pressure in the nozzle meniscus because the resistance of the first manifold 230 and the second manifold 240 are small enough compare than the resistance of other channels.

The equivalent circuit may be different from that described above depending on an actual piping method and an actual structure of the head 100. However, the equivalent circuit described above applies to most cases.

In the preceding description, a positive pressure is applied to the first sub tank 220. However, a differential pressure for liquid circulation may be generated by controlling the pressure in the first sub tank 220 be negative and controlling the negative pressure in the second sub tank 210 to be greater than the negative pressure in the first sub tank 220. That is, an absolute value of the negative pressure in the second sub tank 210 is greater than an absolute value of the negative pressure in the first sub tank 220. Thus, the liquid flows from the first sub tank 220 to the second sub tank 210.

The advantage of the present configuration is that the liquid can be circulated while reducing the liquid leakage from the nozzles 104 compared to the above-described embodiments because the negative pressure is also applied to the first sub tank 220.

However, a pressure fluctuation range in which the liquid is dischargeable may be narrowed when the fluid resistance in the head 100 is large because an initial negative pressure in the nozzle meniscus increases in the negative pressure side.

Here, in Equation 1, the ratio Rout/Rin of the fluid resistance Rout and Rin is represented as Rr (Rr=Rout/Rin) and is transformed to obtain the following Equation 2.

$$Pout=-Rr\times Pin+(1+Rr)\times Pn \quad \text{[Equation 2]}$$

Assuming that the pressure Pn of the nozzle meniscus is a constant value, Pout can be represented as a linear function of the Pin having an intercept of (1+Rr)×Pn and an inclination of −Rr.

If Pin and Pout are set to satisfy the above relation, the differential pressure (Pin−Pout) that circulates the liquid can be increased or decreased while keeping the pressure in the nozzle meniscus constant.

On the other hand, if the pressure increases in the positive direction outside the range of Equation 2, ink may leak from the nozzles 104.

Conversely, if the pressure decreases outside the range of the Equation 2 in the negative direction, bubbles easily enter into the nozzles 104, thereby clogging the nozzle.

Therefore, it is important to vary the differential pressure while keeping the targeted pressure in the nozzle meniscus.

Next, an example of a liquid circulation apparatus 200B according to a second embodiment of the present disclosure is described with reference to FIG. 7.

Figure 7:
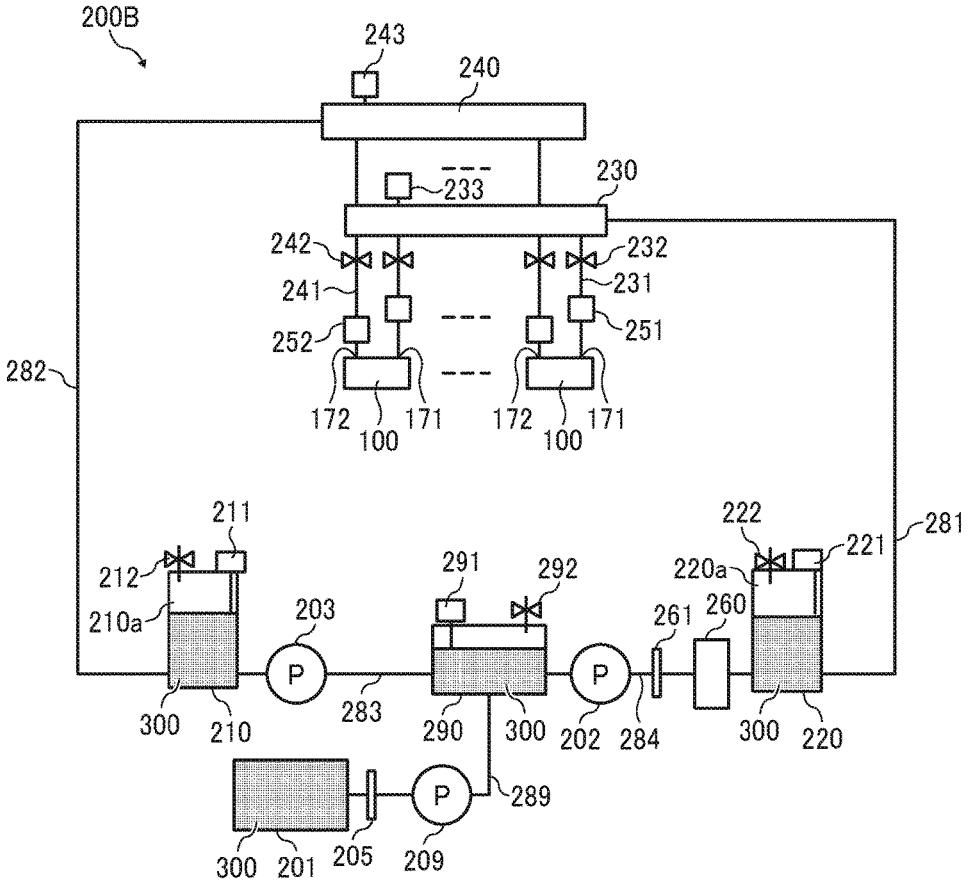
FIG. 7 is a circuit diagram of the liquid circulation apparatus according to a second embodiment of the present disclosure.

FIG. 7 is a schematic view of a liquid circulation apparatus 200B according to the second embodiment.

A liquid circulation apparatus 200B includes a main tank 201, a first sub tank 220, a second sub tank 210, a third sub tank 290, a first supply pump 202, a second supply pump 203, and a third supply pump 209. The main tank 201 stores liquid 300 to be discharged by the heads 100. The main tank 201 acts as a liquid storing device. The main tank 201 may be a liquid cartridge detachable to the liquid circulation apparatus 200B.

The liquid circulation apparatus 200A further includes a first manifold 230, a second manifold 240, a pressure head tank 251, a decompression head tank 252, and a degassing device 260. A plurality of heads 100 communicate with the first manifold 230 and the second manifold 240. The pressure head tank 251 and the decompression head tank 252 are provided for each of the heads 100. The degassing device 260 removes dissolved gas in the liquid.

The third sub tank 290 is disposed between the first sub tank 220 and the second sub tank 210. The third supply pump 209 supplies the liquid to the third sub tank 290 from the main tank 201 via a liquid channel 289 that includes a filter 205.

The third sub tank 290 includes a liquid detector 291 to detect liquid surface of the liquid 300 and a solenoid valve 292 that constitutes an air release mechanism to release inside the third sub tank 290 to the outside air.

The third sub tank 290 and the second sub tank 210 are connected by a liquid channel 283. A second supply pump 203 is provided on the liquid channel 283.

The second sub tank 210 includes a gas chamber 210*a*. Thus, liquid and gas coexist in the second sub tank 210.

The second sub tank 210 includes a liquid detector 211 to detect liquid surface of the liquid 300 and a solenoid valve 212 that constitutes an air release mechanism to release inside the second sub tank 210 to the outside air.

The third sub tank 290 and the first sub tank 220 are connected by a liquid channel 284. A first supply pump 202 is provided on the liquid channel 284.

The degassing device 260 and a filter 261 are arranged on the liquid channel 284.

The first sub tank 220 includes a gas chamber 220*a*. Thus, liquid and gas coexist in the first sub tank 220.

The first sub tank 220 includes a liquid detector 221 to detect liquid surface of the liquid 300 and a solenoid valve 222 that constitutes an air release mechanism to release inside the second sub tank 210 to the outside air.

The first sub tank 220 is connected to the first manifold 230 via the liquid channel 281.

The first manifold 230 is connected to a supply port 171 (see FIG. 3) of the head 100 via the supply channel 231.

The supply channel 231 is connected to the supply port 171 (see FIG. 3) of the head 100 via the pressure head tank 251.

A solenoid valve 232 is provided on an upstream of the pressure head tank 251 on the supply channel 231 to open and close the supply channel 231.

A pressure sensor 233 is provided on the first manifold 230.

The second sub tank 210 is connected to the second manifold 240 via the liquid channel 282.

The second manifold 240 is connected to a discharge port 172 (see FIG. 3) of the head 100 via a discharge channel 241.

The discharge channel 241 is connected to the discharge port 172 (see FIG. 3) of the head 100 via the decompression head tank 252.

A solenoid valve 242 is provided on a downstream of the decompression head tank 252 on the discharge channel 241 to open and close the discharge channel 241.

A pressure sensor 243 is provided on the second manifold 240.

Here, a circulation channel is configured by a route started from the third sub tank 290 and returned to the third sub tank 290 via the liquid channel 284, the first sub tank 220, the liquid channel 281, the degassing device 260, the first manifold 230, the head 100, the second manifold 240, and the second sub tank 210.

Further, the first sub tank 220, the second sub tank 210, the first supply pump 202, and the second supply pump 203 configures a pressure generator to generate a pressure for circulating liquid in the circulation channel.

Next, a liquid circulation method in the liquid circulation apparatus 200B (liquid circulation system) according to the second embodiment of the present disclosure is described.

(1) Liquid flow from the main tank 201 to the third sub tank 290.

When the liquid detector 291 detects liquid shortage in the third sub tank 290, the third supply pump 209 is driven to supply the liquid 300 to the third sub tank 290 from the main tank 201 via the liquid channel 289 until the liquid detector 291 detects that the liquid level in the third sub tank 290 is full.

(2) Liquid flow from the third sub tank 290 to the first sub tank 220.

The liquid 300 is supplied from the third sub tank 290 to the first sub tank 220 via the liquid channel 284 by driving the first supply pump 202.

(3) Liquid flow from the second sub tank 210 to the third sub tank 290.

The liquid is supplied from the second sub tank 210 to the third sub tank 290 via the liquid channel 283 by driving the second supply pump 203.

(4) Liquid flow from the first sub tank 220 to the second sub tank 210 through the liquid-circulable heads 100.

The liquid 300 is supplied to the first sub tank 220 by driving the first supply pump 202 until the pressure sensor 233 detects that pressure in the first manifold 230 becomes the target pressure (positive pressure, for example).

Further, the liquid 300 is supplied to the third sub tank 290 by driving the second supply pump 203 until the pressure sensor 243 detects that pressure in the second manifold 240 becomes the target pressure (negative pressure, for example).

Thus, a differential pressure is generated between the first sub tank 220 and the second sub tank 210.

According to this differential pressure, it is possible to circulate the liquid from the first sub tank 220 to the second sub tank 210 via the liquid channel 281, the filter 261, the degassing device 260, the first manifold 230, a plurality of the supply channels 231, a plurality of pressure head tanks 251, a plurality of heads 100, a plurality of discharge channels 241, a plurality of the decompression head tanks 252, the second manifold 240, and the liquid channel 282.

Figure 8:
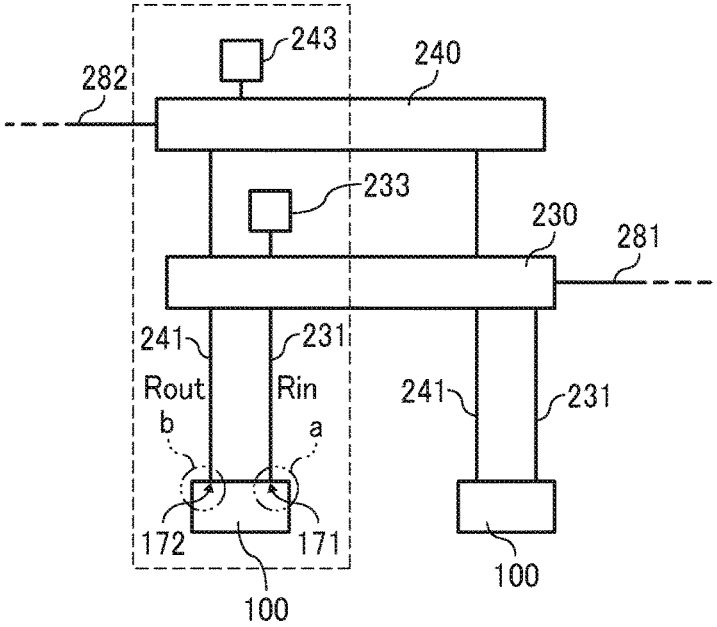
FIG. 8 is an enlarged circuit diagram of liquid channels from the first manifold to the second manifold via the heads in the first embodiment.

FIG. 8 illustrates the liquid circulation apparatus 200A according to the first embodiment of the present disclosure.

FIG. 8 is an enlarged circuit diagram of liquid channels from the first manifold 230 to the second manifold 240 via the heads 100.

In the present embodiment, the fluid resistance from the first manifold 230 to the supply port 171 of the head 100 is represented as Rin. The fluid resistance from the second manifold 240 to the discharge port 172 of the head 100 is represented as Rout. Then, a relation of Rin<Rout is established between Rin and Rout.

A relation between the fluid resistance Rin on the supply side and the fluid resistance Rout on the discharge side with respect to the head 100 is set Rin<Rout as described above. Thus, the ratio of refill from the supply side is increased. Further, the head 100 can stably discharge the liquid, and a flow rate of circulated liquid can be stabilized.

Further, the fluid resistance Rin on the supply side is smaller than the fluid resistance Rout on the discharge side (Rin<Rout). Thus, the pressure loss on the supply side becomes small and the liquid is easily refilled. Thus, liquid is stably supplied to the head 100 and stably discharged from the head 100.

Furthermore, a positive pressure to be set as a target pressure can be made small when forming an identical meniscus pressure in the nozzles 104.

Since the positive pressure can be made small, the possibility of liquid leakage from a joint portion or a connection portion of a piping that configures the supply system is reduced.

Next, an operation and an effect of the present embodiment are described with reference to FIGS. 9 through 11.

Figure 9:
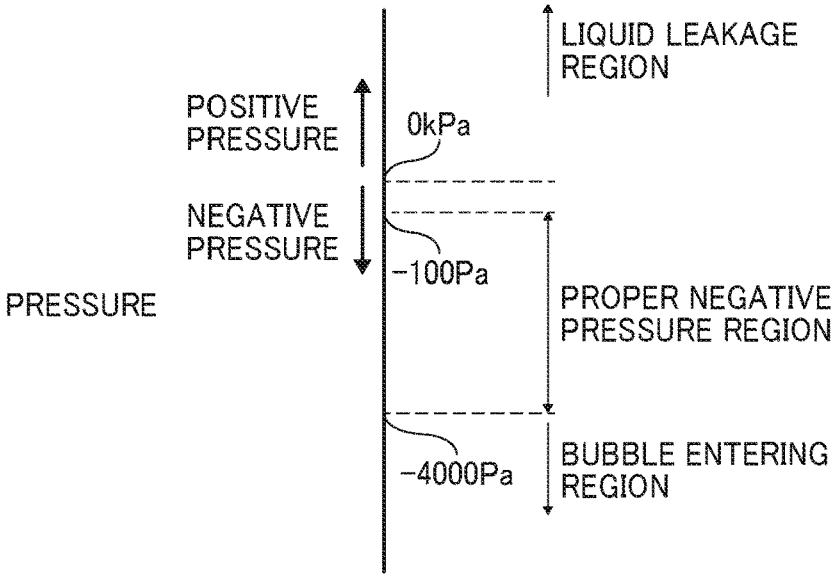
FIG. 9 is a graph that illustrates a range of a meniscus pressure Pm in the nozzles.

FIG. 9 is a graph that illustrates regions of a meniscus pressure in the nozzles 104.

Figure 10:
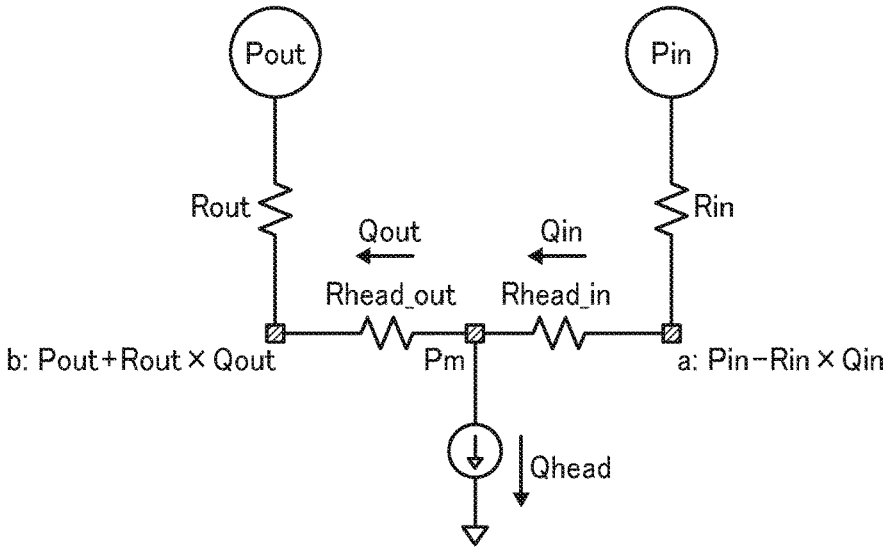
FIG. 10 is schematic view of a liquid channels from the first manifold to the second manifold via the head in FIG. 8 modeled as an equivalent circuit.

FIG. 10 is schematic view of a liquid path from the first manifold 230 to the second manifold 240 via the heads 100 in FIG. 8 modeled as an equivalent circuit.

Here, in the model illustrated in FIG. 10, the fluid resistance and the flow rate in the head 100 are synthesized by all channels (a part related to the liquid discharge for one nozzle is represented by "ch").

Figure 11:
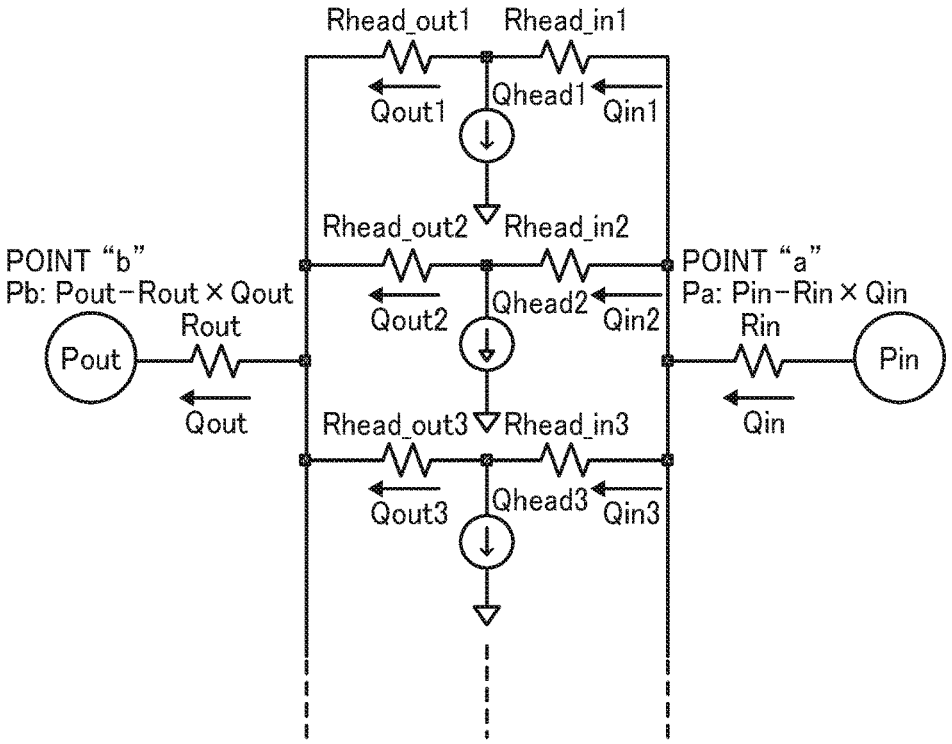
FIG. 11 is an explanatory diagram in which the interior of the head of FIG. 10 is disassembled into individual liquid chambers and represented by an equivalent circuit.

FIG. 11 is a schematic view of the equivalent circuit in which an interior of the head 100 of FIG. 10 is illustrated (disassembled) into a level of the individual liquid chambers 106.

First, referring to FIG. 9, the liquid easily leaks from the nozzles 104 when the meniscus pressure in the nozzle 104 is too large in a positive direction.

Conversely, if the meniscus pressure is too large in a negative direction, meniscus in the nozzles 104 is broken so that bubbles easily enter into the nozzles to cause a malfunction.

Generally, even when the head 100 does not discharge the liquid, a weak negative pressure is set to prevent leakage from the nozzles 104. However, the negative pressure becomes stronger when the head 100 discharges liquid.

Here, the meaning of the negative pressure becoming strong is that the pressure increases toward the negative pressure side in relation to the fluid resistance and the flow rate during discharging liquid.

Therefore, it is important to control the meniscus pressure in the nozzles 104 within a predetermined range.

The meniscus pressure is preferably controlled within a range of proper negative pressure region of −100 Pa to −4000 Pa as illustrated in FIG. 9 depending on various conditions such as types of liquid (viscosity etc.), a nozzle diameter, and an environmental conditions and the like.

Next, a method of calculating the meniscus pressure is described below by defining each parameter as following while focusing on the first channel (1 ch) in FIGS. 10 and 11.

Here, it is assumed that the values of fluid resistance and flow rate are identical between the first channel and the channels after the second channel (2 ch). Thus, a method of calculating the meniscus pressure in the first channel (1 ch) is described here as an example. The calculation of meniscus pressure in other channels after the second channel (2 ch) is abbreviated because it is same as the first channel.

However, in case in which the fluid resistance and the flow rate are different for each channel, the meniscus pressure has to be calculated for each channel.

Here, the first manifold 230 is expressed as "manifold-1", and the second manifold 240 is expressed as "manifold-2". Further, the following parameters are defined and expressed as described below.

Pressure in a manifold-1: Pin

Pressure in a manifold-2: Pout

Meniscus Pressure: Pm

Total number of channels: N

Fluid resistance (supply side) of a supply system: Rin

Fluid resistance of a discharge system (discharge side): Rout

Fluid resistance in the head (supply side): Rhead_in1

A fluid resistance in the head 100 (supply side) Rhead_in1 is a total sum of each fluid resistances of the supply channels and the individual liquid chambers 106 including each of the supply side fluid restrictors 107 in the head 100.

Fluid resistance in the head (discharge side): Rhead_out1

A fluid resistance in the head 100 (discharge side) Rhead_out1 is a total sum of each fluid resistances of the discharge channels including each discharge-side fluid restrictors in the head 100.

Composite fluid resistance of the head (supply side): Rhead_in=Rhead_in1/N

A composite fluid resistance of the head 100 (supply side) "Rhead_in" is a fluid resistance obtained by compounding parallel connections of the fluid resistance in the head 100 (supply side) of Rhead_in1.

Composite fluid resistance of the head (discharge side): Rhead_out=Rhead_out1/N A composite fluid resistance of the head 100 (discharge side) "Rhead_out" is a fluid resistance obtained by compounding parallel connections of the fluid resistance in the head 100 (discharge side) of Rhead_out1.

Ratio of resistance in the head: Rr1

$$Rr1=Rhead_out1/Rhead_in1$$

A ration of the resistance Rr1 in the head 100 is the ratio of the fluid resistance between the supply side and the discharge side of each of the individual liquid chambers 106.

Coefficient of the resistance in the head: $\alpha 1$ $$\alpha 1=Rhead_out1/(Rhead_in1\times Rhead_out1)$$

A flow rate is determined according to a ratio of a fluid resistance on the supply side and the discharge side in the individual-liquid-chamber 106 when a discharge operation is performed with a discharge amount (Qhead1) of the head 100 as described below. A coefficient of the resistance $\alpha 1$ is a coefficient of this flow rate.

Coefficient of the resistance in the head: $\beta 1$ $$\beta 1=Rhead_in1/(Rhead_in1\times Rhead_out1)$$

A flow rate is determined according to a ratio of a fluid resistance on the supply side and the discharge side in the individual-liquid-chamber 106 when a discharge operation is performed with a discharge amount (Qhead1) of the head 100 as described below. A coefficient of the resistance $\beta 1$ is a coefficient of this flow rate.

Composite coefficient of the resistance in the head: $\alpha$ $$\alpha=Rhead_out/(Rhead_in\times Rhead_out)$$

Composite coefficient of the resistance in the head: $\alpha$ $$\beta=Rhead_in/(Rhead_in\times Rhead_out)$$

Coefficient of the resistance $\alpha 1$ and $\beta 1$ in the head 100 and composite coefficient of the resistance $\alpha$ and $\beta$ of the head 100 become the identical value because the fluid resistance of each channels is identical by dividing the total number N of the channels by the denominator molecules.

Flow-through circulation amount: Qft $$Qft=N\times Qft1$$

A flow-through circulation amount Qft is a circulation amount of the liquid 300 constantly circulated through all the channels in the head 100 by flowing the liquid 300 from the manifold-1 (first manifold 230) to the manifold-2 (second manifold 240) through the head 100.

The flow-through circulation amount Qft becomes the sum of the flow rate of the respective channels since the same circulation amount Qft1 flows in each channel.

Circulation amount (supply side): Qin $$Qin=Qft+\alpha\times Qhead$$

A circulation amount (supply side) Qin is a circulation amount on the supply side for all channels in the head 100.

Circulation amount (discharge side): Qout $$Qout=Qft-\beta\times Qhead$$

A circulation amount (discharge side) Qout is the circulation amount on the discharge side for all channels in the head 100.

Flow-through circulation amount: Qft1

A flow-through circulation amount Qft is a circulation amount per channel of the liquid 300 constantly circulated in the head 100 by flowing the liquid 300 from the manifold-1 (first manifold 230) to the manifold-2 (second manifold 240) through the head 100.

Circulation amount (supply side): Qin $$Qin1=Qft1+\alpha\times Qhead1$$

A circulation amount (supply side) Qin1 is a circulation amount per channel on the supply side. In the circulation amount (supply side) Qin, a head discharge amount Qhead1 described below is considered in addition to the above-described flow-through circulation amount Qft1.

Circulation amount (discharge side): Qout1

$$Qout1=Qft1-\beta Qhead1$$

A circulation amount (supply side) Qout1 is a circulation amount per channel on the discharge side. In the circulation amount (discharge side) Qout, a head discharge amount Qhead1 described below is considered in addition to the above described flow-through circulation amount Qft1.

Circulation rate ratio: Qr1

$$Qr1=Qout1/Qin1$$

Discharge flow rate of the head (1 ch): Qhead1

A discharge flow rate of the head (1 ch) Qhead1 is a flow rate of the liquid 300 discharged from the head 100 per one channel (1 ch).

Composite discharge flow rate of the head: Qhead $$Qhead=N\times Qhead1$$

A composite discharge flow rate of the head 100 is a discharge flow rate of the entire heads 100.

Considering a pressure loss from the manifold-1 to the manifold-2 via the supply port 171 and the discharge port 172 of the head 100, the following Equations 3 and 4 are obtained by establishing an equation to find a value of pressures (Pa and Pb) at the supply port 171 (point "a" in FIG. 8) and the discharge port 172 (point "b" in FIG. 8) of the head 100.

From Pin−Pa=Rin×Qin, the following Equation 3 is obtained.

$$Pa=Pin-Rin\times Qin \quad \text{[Equation 3]}$$

From Pb−Pout=Rout×Qout, the following Equation 4 is obtained.

$$Pb=Pout+Rout\times Qout \quad \text{[Equation 4]}$$

The following Equations 5 and 6 are obtained when a relation between the discharge flow rate Qhead1 of the head 100 and the circulation amount Qin1 (supply side) and Qout1 (discharge side) at the time of discharge operation of the head 100 is represented by an equation.

$$Qin1=Qfti+\alpha\times Qhead1 \quad \text{[Equation 5]}$$

$$Qout1=Qfti-\beta\times Qhead1 \quad \text{[Equation 6]}$$

When the liquid 300 is not discharged from the head 100 (when Qhead1=0), the following relation is satisfied.

$$Qin1=Qout1=Qfti$$

Following equations are obtained by forming an equation of a relation between the meniscus pressure Pm and one of the pressure Pa of the supply port 171 and the pressure Pb of the discharge port 172. Tin the following equations, a pressure loss from the manifold-1 to the supply port 171 and a pressure loss from the discharge port 172 to the manifold-2 of the head 100 are taken into consideration.

$$Pm-Pa=Rhead_in1\times Qin1$$

$$Pb-Pm=Rhead_out1\times Qout1$$

Following Equations 7 and 8 are obtained by substituting Equations 3 and 4 into two equations described above.

$$Pm-(Pin-Rin\times Qin)=Rhead_in1\times Qin1 \quad \text{[Equation 7]}$$

$$Pout+Rout\times Qout-Pm=Rhead_out1\times Qout1 \quad \text{[Equation 8]}$$

From the above-described Equations 7 and 8, the following Equation 9 for obtaining the meniscus pressure Pm is obtained.

$$Pm=\{Pout+Rout\times Qout+Rr1\times Qr1\times(Pin-Rin\times Qin)\}/(1+Rr1\times Qr1) \quad \text{[Equation 9]}$$

Next, FIG. 12 illustrates an example in which the meniscus pressure Pm is calculated using the Equation 9 and the parameters described above.

In FIG. 12, a calculation example No. 1 is an example of a reference for comparison.

Calculation examples No. 2 through No. 5 are results of calculation by changing a part of the parameters of the calculation example No. 1.

The parameter changed from the calculation example No. 1 is respectively indicated by bold lines in FIG. 12.

The calculation examples No. 1 through No. 3 are results of calculation in which only circulation process is performed without discharging the liquid 300 from the head 100 (Qhead1=0).

The calculation examples No. 4 and No. 5 are results of calculation in which circulation process is performed with discharging the liquid 300 from the head 100 (when Qhead1 is not equal to zero).

(1) A description of a comparison between the calculation example No. 2 and the calculation Example No. 1 (during non-discharge process in which the liquid 300 is not discharged from the head 100) is given below.

A difference between the calculation example No. 1 and the calculation example No. 2 is that the fluid resistance (supply side) Rin of the supply system is reduced from 1.00E+10 (No. 1) to 1.00E+7 (No. 2).

The meniscus pressure Pm of the calculation example No. 1 is −2658 Pa, whereas the meniscus pressure Pm of the calculation example No. 2 is −993 Pa. It is understood that the meniscus pressure Pm in the negative pressure side decreases when the fluid resistance (supply side) Rin of the supply system is reduced.

Therefore, the effect of preventing an increase of the meniscus pressure Pm in the negative pressure side can be obtained by configuring the fluid resistance (supply side) Rin of the supply system to be smaller.

(2) A description of a comparison between the calculation example No. 3 and the calculation Example No. 1 (during non-discharge process in which the liquid 300 is not discharged from the head 100) is given below.

The calculation example No. 3 is a result of the calculation in which the pressure Pin of the manifold-1 is varied such that the meniscus pressures Pm of the calculation example No. 3 is equal to the meniscus pressure Pm of the calculation example No. 2 while setting the fluid resistance (supply side) Rin of the supply system and the fluid resistance (discharge side) Rout of the supply system as same as in the fluid resistance Rin and Rout of the calculation example No. 1.

In the calculation example No. 2, the pressure Pin is 1000 Pa. However, the meniscus pressure Pm of the calculation example No. 3 does not become equal to the meniscus pressure Pm of the calculation example No. 2 (−933 Pa) unless the pressure Pin is increased to 3498 Pa in the calculation example No. 3.

For example, the pressure Pin of the manifold-1 in the calculation example No. 3 has to be set large to set the meniscus pressure Pm of the calculation example No. 3 to be equal to the calculation example No. 2.

The large pressure Pin may easily cause liquid leak from joints or connections of various pipes.

Thus, size and cost of the liquid discharge apparatus 1000 may be increased to prevent problems caused by the large pressure Pin.

(3) A description of the calculation example No. 4 (during liquid discharge process in which the liquid 300 is discharged from the head 100) is given below.

The calculation example No. 4 is a result considering liquid discharge from the head 100.

A flow rate of the circulation amount (supply side) Qin, the circulation amount (discharge side) Qout, the circulation amount (supply side) Qin1, and the circulation amount (discharge side) Qout1 of the calculation example No. 4 are changed (increased) with respect to each values of the flow rate of the calculation example No. 1 by increasing the discharge flow rate of the head (1 ch) Qhead1 and the composite discharge flow rate of the head Qhead.

Increase in the discharge flow rate of the head Qhead1 and the composite discharge flow rate of the head Qhead invites an increase of the pressure loss. The meniscus pressure Pm is decreased to −4084 Pa, indicating that a large negative pressure is generated.

In this case, the negative pressure exceeding the recommended range of −4000 Pa as described above is generated. Thus, bubbles enter into the nozzles 104 and cause discharge failure.

Therefore, an excessive negative pressure leads to degradation of image quality such as white spots and streaks.

(4) A description on a comparison between the calculation example No. 5 and the calculation example No. 4 (during liquid discharge process) is given below.

The calculation example No. 5 is a result obtained by performing the liquid discharge process while reducing the fluid resistance (supply side) Rin of the supply system from 1.00 E+10 to 1.00 E+7 in addition to a condition as described in the calculation example No. 4.

In this case, the meniscus pressure Pm is about −2221 Pa even if the discharge flow rate Qhead1 and Qhead increases. The pressure loss is suppressed because the fluid resistance (supply side) Rin of the supply system in the calculation example No. 5 is smaller than the fluid resistance (supply side) Rin of the supply system in the calculation example No. 4.

Thus, unlike the calculation example 4, the liquid discharge process within a normal range is possible in the calculation example No. 5.

Therefore, normal image output is expected.

From the above, lowering the fluid resistance (supply side) Rin can decrease the pressure loss from the supply side that makes easier to fill the liquid to the head 100.

Thus, decrease of the meniscus pressure Pm in the negative pressure side can be prevented.

By setting the fluid resistance (supply side) Rin smaller, a positive pressure to be set as the target pressure Pn can be made small when forming the same meniscus pressure Pm.

A second embodiment according to the present disclosure is described with reference to FIG. 13.

Figure 13:
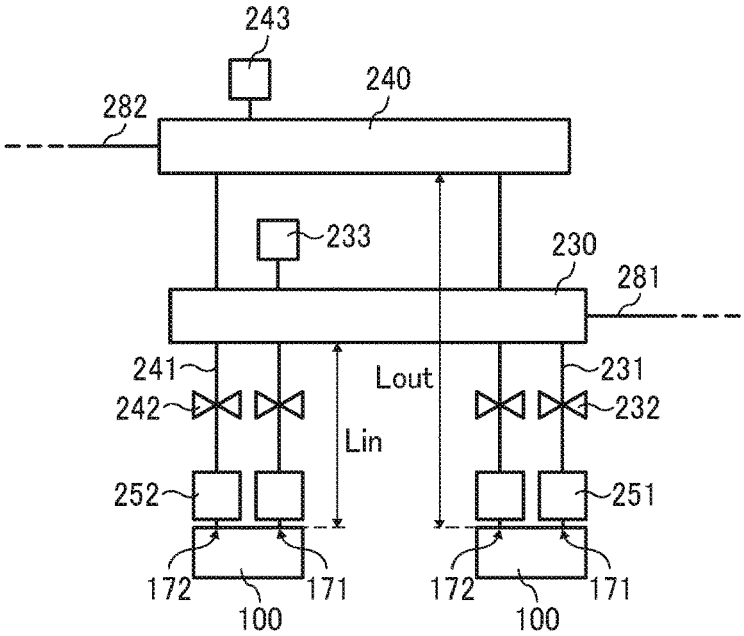
FIG. 13 is an enlarged circuit diagram of liquid channels from the first manifold to the second manifold via the heads according to a second embodiment of the present disclosure.

FIG. 13 is an enlarged circuit diagram of liquid channels from the first manifold 230 to the second manifold 240 via the heads 100.

Here, Lin represents a length from the first manifold 230 to the supply port 171 of the head 100, and Lout represents a length from the discharge port 172 of the head 100 to the second manifold 240. The present embodiment sets the Lin to be smaller than the Lout (Lin<Lout).

That is, the fluid resistance of a circular tube can be generally obtained by the following Equation 10, where μ: viscosity, l: length, and d: diameter.

$$R=(128\times\mu\times l)/(\pi\times d^4) \quad \text{[Equation 10]}$$

Therefore, the fluid resistance (supply side) Rin of the supply system can be made smaller than the fluid resistance (discharge side) Rout of the discharge system by making the length Lin on the supply side shorter than the length Lout on the discharge side (Rin<Rout).

Thus, the present embodiment can reduce a decrease in the circulation flow rate Qin and Qout, prevent the decrease in the meniscus pressure Pm in the negative pressure side, and reduce the positive pressure set as the target pressure Pn when the identical meniscus pressure Pm is to be formed.

Even if a liquid channel is not a circular pipe, a fluid resistance increases with an increase in a length of the channel. Thus, the second embodiment does not limit a shape of the liquid channel, and any types of the liquid channels may be employed.

A third embodiment according to the present disclosure is described with reference to FIG. 14.

Figure 14:
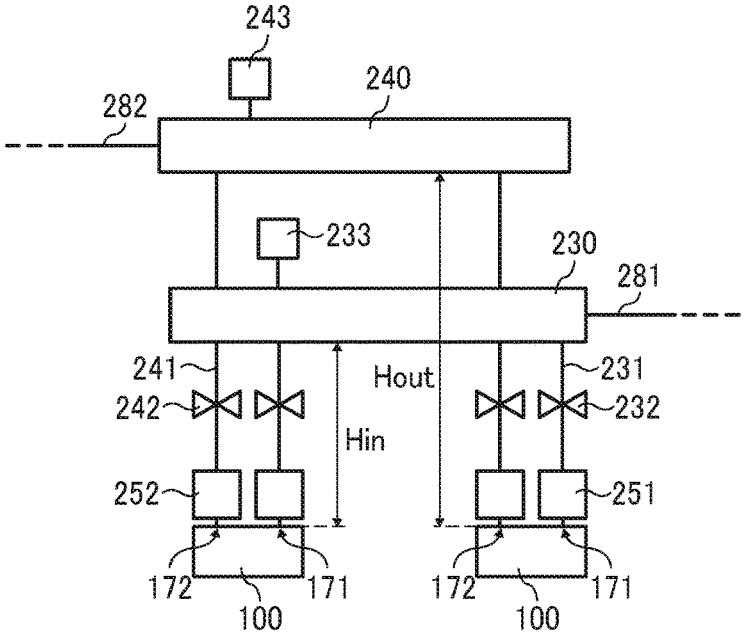
FIG. 14 is an enlarged circuit diagram of liquid channels from the first manifold to the second manifold via the heads according to a third embodiment of the present disclosure.

FIG. 14 is an enlarged circuit diagram of liquid channels from the first manifold 230 to the second manifold 240 via the heads 100.

Hin represents a height from the supply port 171 of the head 100 to the first manifold 230. Hout represents a height from the discharge port 172 of the head 100 to the second manifold 240. The present embodiment sets the Hin to be smaller than the Hout (Hin<Hout).

It is preferable to arrange the first manifold 230 to be closer to the head 100 than the second manifold 240 (Hin<Hout) as an arrangement of the first manifold 230 and the second manifold 240 since a length of the supply channel 231 contributing to the fluid resistance (supply side) Rin can be shortened.

Thus, the present embodiment can easily make the fluid resistance (supply side) Rin of the supply system to be smaller than the fluid resistance (discharge side) Rout (Rin<Rout) of the discharge system.

Thus, the present embodiment can reduce a decrease in the circulation flow rate Qin and Qout, prevent the decrease in the meniscus pressure Pm in the negative pressure side, and reduce the positive pressure set as the target pressure Pn when the identical meniscus pressure Pm is to be formed.

In the present disclosure, discharged "liquid" is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling.

Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant.

Such a solution, a suspension, or an emulsion can be, e.g., inkjet ink, surface treatment solution, a liquid for forming components of electronic element or light-emitting element or a resist pattern of electronic circuit, or a material solution for three-dimensional fabrication.

The "liquid discharge head" includes an energy source for generating energy to discharge liquid. Examples of the energy source include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

In the present disclosure, "liquid discharge apparatus" refers to an apparatus including a liquid discharge head or a liquid discharge unit, configured to discharge a liquid by driving the liquid discharge head.

The liquid discharge apparatus may be, for example, an apparatus capable of discharging liquid onto a material to which liquid can adhere or an apparatus to discharge liquid into a gas or another liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid.

For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell. The "medium on which liquid can be adhered" includes any medium on which liquid is adhered, unless particularly limited.

Examples of "the material on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a head and a medium on which liquid can be adhered. However, the liquid discharge apparatus is not limited to such an apparatus.

For example, the liquid discharge apparatus may be a serial head apparatus that moves the head or a line head apparatus that does not move the head.

Examples of "the liquid discharge apparatus" further include a treatment liquid coating apparatus to discharge a treatment liquid to a sheet surface to coat the sheet surface with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid circulation apparatus, comprising a circulation channel through which a liquid is circulated via a liquid discharge head including a supply port and a discharge port, the circulation channel including:

a first manifold communicating with the supply port of the liquid discharge head;

a second manifold communicating with the discharge port of the liquid discharge head;

a supply channel connecting the first manifold and the supply port of the liquid discharge head; and a discharge channel connecting the second manifold and the discharge port of the liquid discharge head, a fluid resistance from the first manifold to the supply port of the liquid discharge head via the supply channel being smaller than a fluid resistance from the second manifold to the discharge port of the liquid discharge head via the discharge channel.

2. The liquid circulation apparatus according to claim 1, wherein a length of the supply channel is smaller than a length of the discharge channel.

3. The liquid circulation apparatus according to claim 1, wherein the second manifold is disposed higher than the first manifold.

4. The liquid circulation apparatus according to claim 1, further comprising a plurality of liquid discharge heads, the plurality of liquid discharge heads communicating with the first manifold and the second manifold.

5. The liquid circulation apparatus according to claim 1, further comprising a pressure head tank and a decompression head tank provided to each of the liquid discharge heads.

6. The liquid circulation apparatus according to claim 1, further comprising:

a first sub tank connected to the first manifold; and a second sub tank connected to the second manifold, wherein a differential pressure is generated between the first sub tank and the second sub tank by setting a pressure in the first sub tank to positive and setting a pressure in the second sub tank to negative.

7. The liquid circulation apparatus according to claim 1, further comprising:

a first sub tank connected to the first manifold; and a second sub tank connected to the second manifold, wherein a differential pressure is generated between the first sub tank and the second sub tank by setting a pressure in the first sub tank and the second sub tank to negative, and an absolute value of the pressure in the second sub tank is greater than an absolute value of the pressure in the first sub tank.

8. A liquid discharge apparatus comprising the liquid circulation apparatus according to claim 1.

9. A liquid circulation apparatus, comprising a circulation channel through which a liquid is circulated via a liquid discharge head including a supply port and a discharge port, the circulation channel including:

a first manifold communicating with the supply port of the liquid discharge head;

a second manifold communicating with the discharge port of the liquid discharge head;

a supply channel connecting the first manifold and the supply port of the liquid discharge head; and a discharge channel connecting the second manifold and the discharge port of the liquid discharge head, a length of the supply channel being smaller than a length of the discharge channel.

10. A liquid circulation apparatus, comprising a circulation channel through which a liquid is circulated via a liquid discharge head including a supply port and a discharge port, the circulation channel including:

a first manifold communicating with the supply port of the liquid discharge head; and a second manifold communicating with the discharge port of the liquid discharge head, the second manifold disposed higher than the first manifold.

* * * * *